US010473021B2

(12) United States Patent
Cheng et al.

(10) Patent No.: US 10,473,021 B2
(45) Date of Patent: Nov. 12, 2019

(54) EXHAUST SYSTEM AND METHOD OF USING

(71) Applicant: TAIWAN SEMICONDUCTOR MANUFACTURING COMPANY, LTD., Hsinchu (TW)

(72) Inventors: Wei Chang Cheng, Hsinchu (TW); Ping-Hsu Chen, Hsinchu (TW); Chi-Hung Liao, Sanchong (TW); T. S. Lo, Erlin Township (TW); Yung-Yao Lee, Zhubei (TW)

(73) Assignee: TAIWAN SEMICONDUCTOR MANUFACTURING COMPANY, LTD., Hsinchu (TW)

( * ) Notice: Subject to any disclaimer, the term of this patent is extended or adjusted under 35 U.S.C. 154(b) by 140 days.

(21) Appl. No.: 15/651,373

(22) Filed: Jul. 17, 2017

(65) Prior Publication Data

US 2018/0149067 A1 May 31, 2018

Related U.S. Application Data

(60) Provisional application No. 62/427,600, filed on Nov. 29, 2016.

(51) Int. Cl.

| | |
|---|---|
| ***F15D 1/04*** | (2006.01) |
| ***F01N 13/08*** | (2010.01) |
| ***F15D 1/00*** | (2006.01) |

(52) U.S. Cl.

CPC ..... *F01N 13/08* (2013.01); *F15D 1/0015* (2013.01); *F01N 2240/20* (2013.01); *F01N 2260/06* (2013.01); *F01N 2470/30* (2013.01)

(58) Field of Classification Search

CPC ..... F15D 1/001; F15D 1/0015; F15D 1/009; F01N 13/08; F02M 29/02; F02M 29/06

USPC ..... 138/37, 39; 60/324; 123/590, 184.21, 123/592

See application file for complete search history.

(56) References Cited

U.S. PATENT DOCUMENTS

| | | | | |
|---|---|---|---|---|
| 3,813,854 | A * | 6/1974 | Hortman | B01D 45/16 55/399 |
| 4,280,360 | A * | 7/1981 | Kobayashi | G01F 1/3209 138/37 |
| 5,113,838 | A * | 5/1992 | Kim | F02M 29/06 123/590 |
| 5,916,134 | A * | 6/1999 | Yang | F01N 3/2892 60/299 |
| 5,947,081 | A * | 9/1999 | Kim | F02M 35/022 123/306 |

(Continued)

*Primary Examiner* — Patrick F Brinson

(74) *Attorney, Agent, or Firm* — Hauptman Ham, LLP

(57) ABSTRACT

A vortex generator for an exhaust system includes an annular bearing for mounting on an interior surface of an exhaust line. The vortex generator further includes a flow splitter mounted on the annular bearing. The flow splitter includes a leading face with an upstream opening. The flow splitter further includes a trailing face with a downstream opening, wherein the upstream opening and the downstream opening are centered around a longitudinal axis of the exhaust line. The flow splitter further includes a side extending from the leading face to the trailing face, wherein the side has a plurality of openings, each opening of the plurality of openings containing a blade, and wherein a trailing side of each blade faces the longitudinal axis.

20 Claims, 9 Drawing Sheets

(56) References Cited

U.S. PATENT DOCUMENTS

| | | | | |
|---|---|---|---|---|
| 6,796,296 | B2 * | 9/2004 | Kim | B01F 5/0618 123/184.21 |
| 6,901,907 | B2 * | 6/2005 | Wijaya | F02M 29/06 123/306 |
| 7,028,663 | B1 * | 4/2006 | Kim | F01N 13/08 123/306 |
| 7,086,498 | B2 * | 8/2006 | Choi | F01N 1/083 181/270 |
| 7,131,514 | B2 * | 11/2006 | Choi | F01N 1/083 181/270 |
| 7,267,098 | B1 * | 9/2007 | Tasanont | F02B 31/04 123/306 |
| 8,043,394 | B2 * | 10/2011 | Mital | B01F 3/04049 422/177 |
| 8,220,444 | B2 * | 7/2012 | Cheung | F02M 29/06 123/306 |
| 8,615,984 | B2 * | 12/2013 | Kornherr | B01D 53/90 60/286 |
| 9,534,525 | B2 * | 1/2017 | Dalimonte | F01N 3/021 |
| 2006/0048745 | A1 * | 3/2006 | Huckelberry | F02M 29/02 123/306 |
| 2010/0146956 | A1 * | 6/2010 | Grudynski, III | F01N 13/08 60/324 |

* cited by examiner

EXHAUST SYSTEM AND METHOD OF USING

BACKGROUND

Flow disruption sites in an exhaust system impedes removal of gases and particles from an upstream source of the exhaust system. Bends and connectors in exhaust lines disrupt exhaust flow by slowing the movement of exhaust, which reduces pumping efficiency. Particulate matter suspended or transported by the exhaust system tends to collect at flow disruption sites in the exhaust system. Buildup of particulate matter in an exhaust line reduces an area of the exhaust line available for exhaust and particles to flow through the exhaust system. Buildup of particulate matter reduces pumping efficiency and leads to increased maintenance to manually remove buildup and maintain uninterrupted exhaust flow within desired specifications and consequently reduces operating efficiency.

BRIEF DESCRIPTION OF THE DRAWINGS

The present disclosure is best understood from the following detailed description when read with the accompanying figures. It is emphasized that, in accordance with the standard practice in the industry, various features are not drawn to scale and are used for illustration purposes only. In fact, the dimensions of the various features may be arbitrarily increased or reduced for clarity of discussion.

DESCRIPTION

Figure 1:
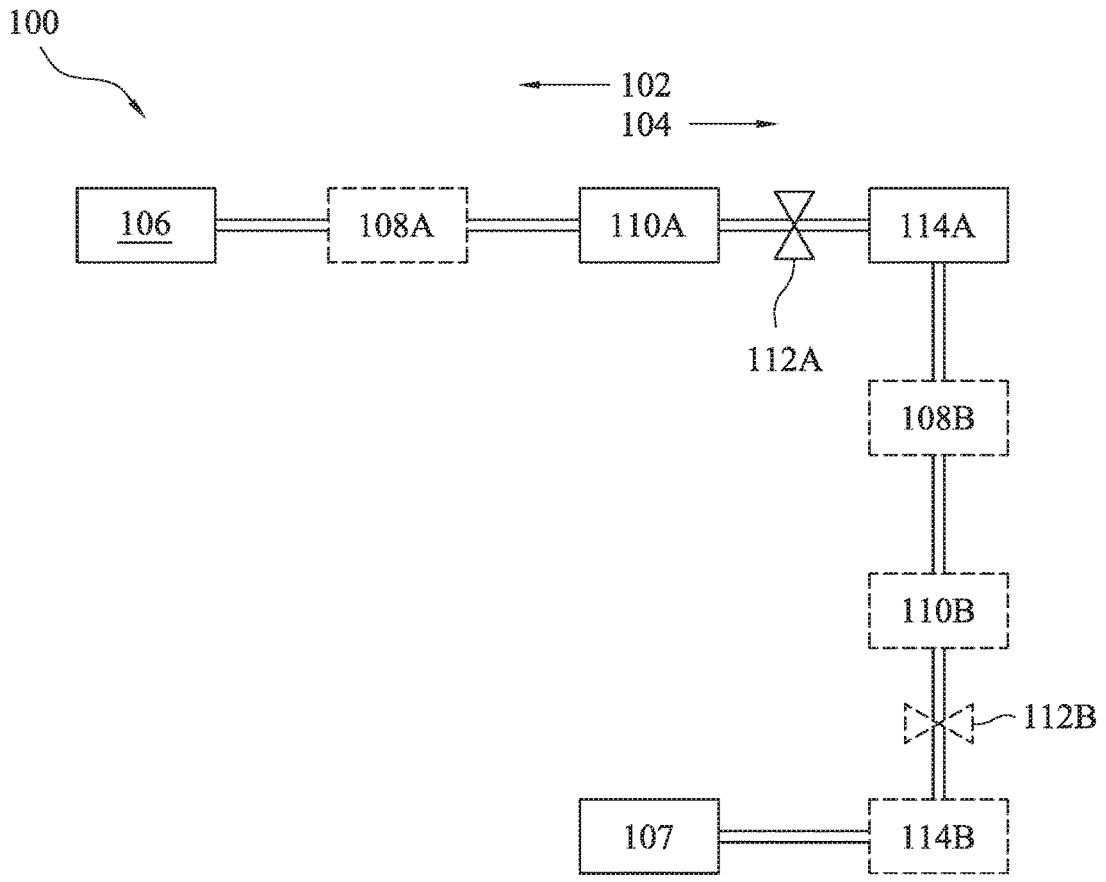
FIG. 1 is a schematic diagram of an exhaust system, according to some embodiments.

The following disclosure provides many different embodiments, or examples, for implementing different features of the provided subject matter. Specific examples of components, values, operations, materials, arrangements, etc., are described below to simplify the present disclosure. These are, of course, merely examples and are not intended to be limiting. Other components, values, operations, materials, arrangements, etc., are contemplated. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Many exhaust systems handle exhaust streams that include particulate matter. In some instances, particulate matter builds up at flow disruption sites within the exhaust system. A flow disruption leads to a decrease in flow velocity through the exhaust system. Flow velocity through the exhaust system changes based on changes in exhaust line diameters, changes in bends in exhaust lines, and changes at connectors between exhaust lines. Decreased flow velocity results in particles, which are suspended in the exhaust stream, contacting and adhering to interior walls of the exhaust system lines, or other particles adhered to the interior walls, with greater frequency than with nominal flows of the exhaust system. Nominal flow velocity overcomes frictional forces that adhere particles to interior walls of exhaust lines or other particles. Adhering particles create a compound effect that, once begun, promotes further particle adhesion where particles have begun to collect in an exhaust line.

Over time, particle buildup in the exhaust system reduces the flow velocity for the exhaust system. Reduced flow velocity corresponds to reduced particle removal efficiency. In some instances, reduced flow velocity and reduced particle removal efficiency contribute to contamination of semiconductor wafers or other materials that are handled by manufacturing equipment. Maintenance of the exhaust system to remove the adhered particles from the exhaust lines restores clogged systems to nominal functionality. However, maintenance includes removing a tool with the exhaust system from normal operation during performance of the maintenance procedure. Maintenance due to particulate contamination reduces availability and productivity of manufacturing equipment. Enhancing the flow velocity at flow disruption sites increases the likelihood that a particle suspended in the exhaust stream will pass through the flow disruption site, rather than adhere to inner walls of the exhaust line or other particles. An exhaust system containing a vortex generator adds rotational motion to the exhaust stream in order to enhance particle pass-through at flow disruption sites in the exhaust system. A vortex (rotational flow) in an exhaust stream extends past a location where the vortex is generated in the exhaust system to increase flow velocity close to inner walls of the exhaust line. Higher flow velocity near the inner walls of an exhaust line reduces particle adhesion on the exhaust line walls and reduces the rate of particle buildup at flow disruption sites. Interior walls of an exhaust line are metallic, in some embodiments. In some embodiments, the interior wall of an exhaust line is a coated surface. The coating on the coated surface includes, in some embodiments, at least one of polytetrafluoroethylene (PTFE), polyurethane, polypropylene, nylon, or another coating with a coefficient of static friction that is smaller than the coefficient of static friction of stainless steel.

FIG. 1 is a schematic diagram of an exhaust system 100 according to some embodiments of the present disclosure. Exhaust system 100 is configured to be attached to a manufacturing tool. Exhaust system 100 is configured to pump gases and particles out of manufacturing tools through exhaust lines connected to a pump or a vacuum source. Exhaust system 100 has an upstream direction 102 and a downstream direction 104. Exhaust system source 106 is at one end of exhaust system 100 in upstream direction 102, and exhaust pump 107 is at another end of exhaust system 100 in downstream direction 104. In some embodiments, exhaust system 100 includes multiple exhaust system sources 106. In some embodiments, exhaust system 100 includes multiple exhaust pumps 107.

Some non-limiting examples of manufacturing tools that are attachable to exhaust system 100 include semiconductor manufacturing tools. In some embodiments, exhaust system source 106 is a photolithography tool. In some embodiments, exhaust system source 106 is a furnace for annealing. In some embodiments, exhaust system source 106 is an etch chamber. In some embodiments, exhaust system source 106 is a diffusion chamber. As a non-limiting example, some photolithography tools are configured to deposit and bake photoresist on semiconductor wafers. Baking wafers treats and modifies the photoresist to remove solvent from the photoresist and to stabilize the photoresist prior to wafer etching. Baking the photoresist generates particles (e.g., flakes of dried photoresist) as well as waste gases. Particles, waste gases, and chamber purge gases exit the photolithography tool through exhaust system 100. Photoresist particles are exhausted in order to reduce contamination of semiconductor wafers during wafer handling and processing steps inside the photolithography tool. The gaseous exhaust component includes, in some embodiments, a purge gas (e.g., nitrogen and oxygen) added to a bake chamber in order to flush solvents and moisture from the bake chamber and to preserve a desired processing condition during wafer baking. In some embodiments, the gaseous component of an exhaust includes compressed air. In some embodiments, the gaseous component includes dried compressed air. In some embodiments, the particulate component of an exhaust includes photoresist residue that has lifted off or spalled from a semiconductor wafer. Sometimes particulate contamination comes from sources external to the manufacturing tool, or from moving parts within the photolithography tool.

Exhaust system 100 contains an optional velocity booster 108A between exhaust system source 106 and exhaust pump 107. Velocity booster 108A is not optional in some embodiments of exhaust system 100. Velocity booster 108A is configured to increase a flow velocity of the gases and particles of the exhaust originating in exhaust system source 106 in exhaust system 100. Exhaust system 100 may also contain a vortex generator 110A between velocity booster 108A and exhaust pump 107. Vortex generator 110A is configured to impart a component of rotational motion to exhaust of exhaust system 100. Rotational motion of exhaust (a vortex) shrinks a boundary layer along an interior surface of the exhaust lines of exhaust system 100 and improves particle removal efficiency at flow disruption sites of exhaust system 100. A dead space is a region inside the exhaust lines where flow velocity is minimal or even where an eddy current is present within the exhaust line. In some instances, an eddy current is generated where a flow contacts a surface, e.g., a reducing connector, and a back flow is generated. In some embodiments, the exhaust in exhaust system 100 is able to generate a component of rotational flow (a vortex) when passing through vortex generator 110A without inclusion of velocity booster 108A. In some embodiments, velocity booster 108A is an injector of particle-free gas. In some embodiments, velocity booster 108A is a Bernoulli device that draws external gas through gas inlet openings at a leading face (or, on an outer surface) of the Bernoulli device, and emits the gas into exhaust system 100 through outlet openings, smaller than the gas inlet openings, on a trailing face (or, on an interior surface) of the Bernoulli device. In some embodiments, the external openings of the Bernoulli device completely circumscribe an exhaust line of exhaust system 100. In some embodiments, gas inlet openings of the Bernoulli device are separated from each other around the exhaust line of exhaust system 100. In some embodiments, the gas inlet openings of the Bernoulli device are on a single side of the exhaust line while the gas outlet openings circumscribe the exhaust line. In some embodiments, the internal openings of the Bernoulli device are arranged in a circular pattern around an interior of the exhaust line of exhaust system 100. In some embodiments, gas outlet openings are inside an exhaust line of exhaust system 100. In some embodiments, gas outlet openings are against an outer surface of exhaust system 100 and align with holes in an exhaust line of exhaust system 100.

In some embodiments, vortex generator 110A has a flow splitter attached to a rotational bearing, the rotational bearing attached to an inner wall of the exhaust line. In some non-limiting embodiments, the flow splitter of vortex generator 110A has openings that allow gas to travel from an outer region of the exhaust line (a peripheral portion) to a central region (a central portion) of the exhaust line. The flow splitter has blades in the openings that, as the exhaust moves over the blades, redirect the peripheral portion of the exhaust to move around a longitudinal axis extending through the exhaust line and vortex generator 110A. The flow splitter, attached to the rotational bearing, is capable of rotating as gas moves through the openings and moves over the blades. In some embodiments, the blades are straight. In some embodiments, the blades are curved. In some embodiments, the blades extend at least half of the distance between a center of the flow splitter and a side of the flow splitter. In some embodiments, the blades extend out past a side of the flow splitter into the peripheral region between the flow splitter side and the interior wall of the exhaust line. A leading side of a blade faces an interior wall of the exhaust line where velocity booster 110A is positioned. A trailing side of a blade faces the longitudinal axis through velocity booster 110A.

Exhaust system 100 may also contain a flow regulator 112A downstream from vortex generator 110A and upstream from flow disruption site 114A. In some embodiments, flow regulator 112A is located at a different location in exhaust system to help regulate exhaust flow velocity. In some embodiments, flow regulator 112A is downstream of flow disruption site 114A. In some embodiments, flow regulator 112A is upstream of vortex generator 110A. Flow regulator 112A adjusts a flow velocity of the exhaust in order to regulate the overall flow velocity through flow disruption site 114A. In some embodiments, flow regulator 112A is a ball valve. In some embodiments, flow regulator 112A is a butterfly valve, a plug valve, a ball valve, or another suitable valve.

In some embodiments, exhaust system 100 has a bypass branch (not shown) to allow repair and reconfiguration of flow regulator 112A without shutting down exhaust system source 106. In some embodiments, whether exhaust flows through the bypass branch of exhaust system 100 or through the flow regulator branch is determined by a position of a flow switch mechanism (not shown). In some embodiments, the flow switch mechanism is a shutoff valve that isolates one of the bypass branch or the flow regulator branch. In some embodiments, one or more butterfly valves regulates gas flow between the bypass branch and the flow regulator branch.

In some embodiments, flow regulator 112A is manually adjustable. In some embodiments, flow regulator 112A is electronically controlled by a control loop that senses exhaust flow in the exhaust system. In some embodiments, flow regulator 112A is electronically controlled by a control loop that senses a pressure differential between an interior of the exhaust line and the exterior of the exhaust line.

Particles tend to collect in exhaust system 100 at flow disruption sites such as flow disruption site 114A. Flow disruption site 114A is a location in exhaust system 100 where flow is disrupted (slowed, or becomes turbulent). Particle movement is not sustained as well in disrupted (turbulent) flow as in smooth or laminar flow. Particle movement is sustained better in faster exhaust flow than in slower exhaust flow in an exhaust line. Thus, particles tend to make contact with interior walls of exhaust lines where flow slows or becomes turbulent. When particles contact interior walls of exhaust lines, the particles have a tendency to adhere to interior walls unless the exhaust lifts the particles from the interior surface of the exhaust line.

In some embodiments, flow disruption site 114A includes a bend in an exhaust line. In some embodiments, flow disruption site 114A includes a connector between exhaust lines, where an upstream line is attached to the connector at one side and a downstream line is attached to another side of the connector. In some embodiments, the connector is a reducing connector (a reducer), where the upstream line has a larger diameter than the downstream line. In some embodiments, the reducer is a concentric reducer or an eccentric reducer. In some embodiments, the connector is a straight connector, where the upstream line and the downstream line share a common axis down a center of the exhaust line. In some embodiments, the connector is an angled connector, where the incoming line (the upstream line) and the exiting line (the downstream line) do not share a common axis of alignment. In some embodiments, the angled connector is a 90° connector between an incoming exhaust line and an outgoing exhaust line. In some embodiments, the angled connector is a 45° connector, a 30° connector or another suitable angled connector. For angled connectors, particles sometimes have sufficient momentum to bump into the "far" or "facing" interior wall of the exhaust line that is in a direct path with the incoming exhaust line entering flow disruption site 114A.

A non-limiting example of flow disruption site 114A is a 90° connector having an inlet exhaust line opening and an outlet exhaust line opening, at a right angle to each other. The intersection of the openings has angled interior surfaces, not smooth interior surfaces. An angled interior surface is sometimes associated with "dead" spots (locations with no exhaust flow) in an exhaust stream. Locations with no flow, or reduced flow, are more likely locations to experience particle buildup in an exhaust line of exhaust system 100. In a non-limiting example that includes smoother interior surfaces, the risk of "dead" spots would decrease; however, the redirecting of the exhaust would still reduce the flow velocity and increase the risk of particle build up.

In some embodiments, flow disruption site 114A includes a region of exhaust line where an interior surface of the exhaust line is rough or uneven. Rough or uneven interior surfaces occur at connectors, at locations where segments of line join (such as welded seams), and at locations where connectors (such as for sensors) are attached to an exhaust line. In some embodiments, flow disruption site 114A is a segment of exhaust line without a particle-shedding coating on an interior wall of the exhaust line.

Exhaust pump 107 is downstream of each element of exhaust system 100 and draws, due to a pressure differential between exhaust pump 107 and upstream elements of exhaust system 100, the gaseous and particulate components of the exhaust stream into exhaust pump 107 and out of exhaust system 100. In some embodiments, exhaust system 100 contains a particle filtration unit upstream from exhaust pump 107. In some embodiments, exhaust system 100 contains a washing unit or scrubber to remove particulate matter from an exhaust stream.

Exhaust system 100 contains an optional second flow disruption site 114B located downstream of flow disruption site 114A. Exhaust system 100 also contains an optional second velocity booster 108B upstream of a second vortex generator 110B, and an optional second flow regulator 112B between second vortex generator 110B and second flow disruption site 114B. Some embodiments of exhaust system contain multiple flow disruption sites, where less than all of the flow disruption sites are downstream from vortex generators. In some embodiments, vortex generator 110B generates a vortex in exhaust system 100 that will enhance particle throughput through multiple flow disruption sites downstream of vortex generator 110B. In some embodiments, exhaust system 100 includes multiple flow disruption sites, e.g., flow disruption site 114A and flow disruption site 114B, and a single vortex generator, e.g., vortex generator 110A.

Figure 2A:
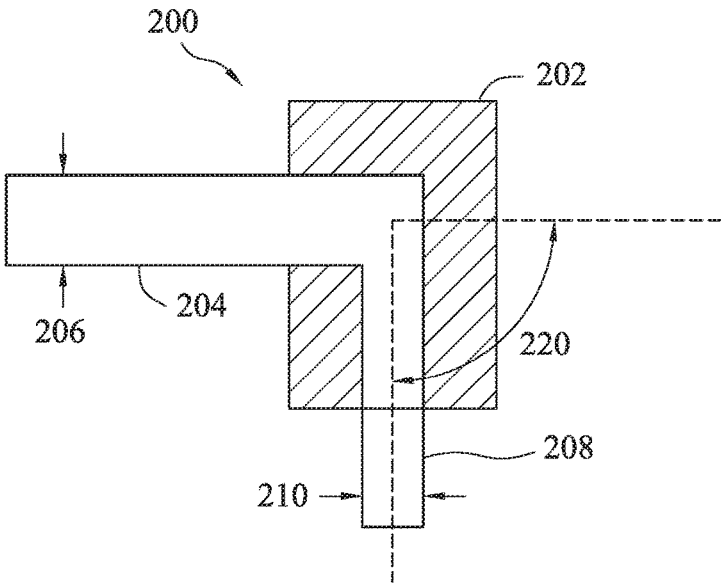
FIGS. 2A-2B are cross-sectional views of flow restriction points of an exhaust system, according to embodiments.

FIG. 2A is a cross-sectional diagram of a flow disruption site 200 in an exhaust system, according to some embodiments. Flow disruption site 200 occurs at a connector 202 connected, at an upstream side, to inlet line 204, having an inlet line inner diameter (ID) 206, and connected, at a downstream side, to outlet line 208 having an outlet line ID 210. Inlet line 204 and outlet line 210 are at an angle 220 to each other. Angle 220 may be about 90°, as illustrated in FIG. 2A. In some embodiments, angle 220 at flow disruption site 200 ranges from 0° (a straight connector) to about 90° (a perpendicular connector). As angle 220 increases to 90°, a risk of particle accumulation at flow disruption site 200 increases. In a situation where angle 220 exceeds 90°, a vector of the flow velocity exiting flow disruption site 200 would be opposite to a direction of flow velocity entering the flow disruption site and a "dead" zone would be created.

In some embodiments, inlet line ID 206 is larger than outlet line ID 210. In some embodiments, inlet line ID 206 is smaller than outlet line ID 210. In some embodiments, inlet line ID 206 is the same as outlet line ID 210. In some embodiments, inlet line ID 206 ranges from about 1 cm to about 3 cm. When inlet line ID 206 is smaller than about 1 cm, the inner diameter of the line inhibits formation of a vortex within the exhaust line. When inlet line ID 206 is greater than about 3 cm, the rate of exhaust flow through the flow disruption site is generally sufficiently high to reduce the utility of including a vortex generator (described further, below). In some embodiments, outlet line ID 210 ranges from about 0.5 cm to about 2 cm. When outlet line ID 210 is smaller than about 0.5 cm, the removal rate of exhaust is too low to significantly benefit from a vortex formed upstream of the flow disruption site and particles spin in the disruption site instead of continuing smoothly through the flow disruption site. When outlet line ID 210 is greater than about 2 cm, the diameter differential between inlet line and outlet line is sufficiently small that a vortex does not significantly benefit particle removal (or, adhesion prevention) at flow disruption sites. In some embodiments, a ratio of inlet line ID 206 to outlet line ID 210 ranges from about 1:1 to about 4:1. When a ratio of inlet line ID 206 to outlet line ID 210 is larger than about 4:1, there is insufficient exhaust throughput through flow disruption site 200 to significantly benefit from a vortex generator at an upstream position to enhance particle throughput through flow disruption site 200. When a ratio of inlet line ID 206 to outlet line ID 210 is smaller than 1:1 (i.e., the outlet is larger than the input), a vortex generator does not significantly enhance particle throughput through flow disruption site 200 because the downstream side of flow disruption site 200 does not impede particle removal.

In some embodiments, flow disruption site 200 has a smooth interior wall between inlet line 204 and outlet line 208. In some embodiments, connector 202 has a ridged interior, where the inner surface is broken by a seam between an end of the exhaust line and an interior wall of connector 202. In some embodiments, a flow disruption site is an exhaust line inner sidewall that is abraded or scratched, where particles tend to cluster at the abrasion site. In some embodiments, connector 202 has "no-flow" locations or "dead spots" within connector 202. A "dead spot" is a location in a connector body where a space exists that is outside of a laminar flow region through connector 202. In some embodiments, a "dead spot" is at a ridge in connector 202, such as occurs with an inner diameter change between inlet line 204 and outlet line 208. In some embodiments, a "dead spot" occurs where a connector body is machined to form the inlet opening and outlet opening. In at least one non-limiting example of a "dead spot" in connector 202, an interior wall of an inlet opening has at least one conical recess into the connector body, where the conical recess corresponds to a volume of connector body material removed by a machining tool, e.g., a drill tip, during formation of a connector body opening.

Figure 2B:
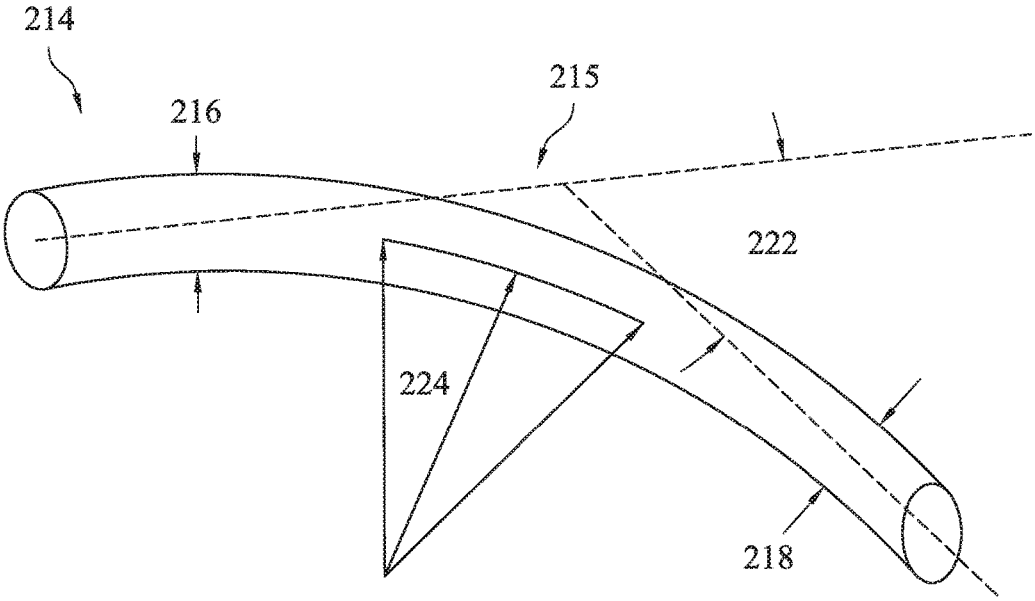

FIG. 2B is a cross-sectional diagram of a flow disruption site 214, according to some embodiments. Flow disruption site 214 is an exhaust line 215. Flow disruption site 214 has an inlet ID 216 and an outlet ID 218, where inlet ID 216 and outlet ID 218 are equal. Flow disruption site 214 has a bend angle 222 with a radius of curvature 224. In some embodiments, bend angle 222 ranges from about 90° to 0°. In some embodiments, inlet line ID 216 ranges from 1.0 cm to 5.0 cm. In some embodiments, radius of curvature 224 ranges from about 100% and about 400% of inlet line ID 216. When bend angle 222 is greater than 90°, the exhaust stream tends to lose sufficient velocity at the bend that particles collect quickly and increase tool maintenance requirements. At bend angles of less than about 45°, the vortex from the vortex generator is generally able to extend through flow disruption site 214. As a non-limiting example, a flow disruption in exhaust line 215 at bend angles from 0° and 45° is sometimes the result of a temperature differential (typically colder at the site) between the bent section of exhaust line 215 and upstream portions (typically warmer upstream from the site). In some embodiments, a temperature differential at the site is sometimes the result of a loose heating jacket on an exhaust line, reducing an ability to warm the pipe and prevent condensation gases in the exhaust on an interior wall of exhaust line. In some embodiments, flow disruptions result from a different liner material (or no liner material) at flow disruption site 214 than at upstream positions of exhaust line 215. According to a gas flow velocity and a density of gas in the exhaust system, at bend angles from about 90° and about 45°, a vortex in the exhaust system extends to flow disruption site 214, but not through the site.

Figure 3A:
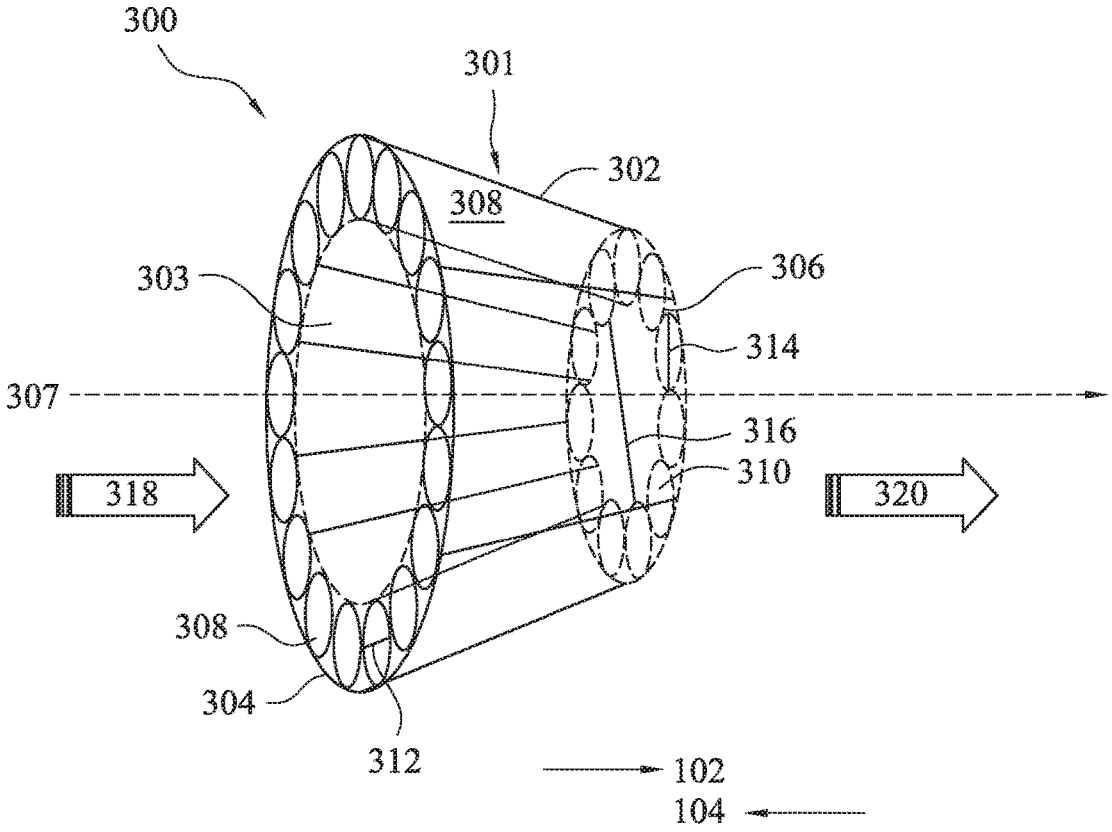
FIG. 3A is a perspective view of a velocity booster, according to some embodiments.

FIG. 3A is a perspective view of a velocity booster 300, according to some embodiments. Velocity booster 300 is usable as velocity booster 108A (FIG. 1). In some embodiments, velocity booster 300 is a connector with a central opening that fastens to an outside of an exhaust line. In some embodiments, velocity booster 300 has a hinge and a fastening element and removably fastens around an exhaust line. In some embodiments, velocity booster 300 is permanently fastened to an exhaust line. Velocity booster 300 has a booster body 301 with an outer surface 302, an inner surface 303, a leading face 304 (where gas enters velocity booster 300) and a trailing face 306 (where gas exits velocity booster 300 and enters an exhaust line). Gas enters velocity booster 300 through inlet openings 308 in leading face 304, and exits velocity booster 300 through outlet openings 310 in trailing face 306. In some embodiments, where velocity booster 300 fastens to an outer surface of an exhaust line (i.e., where the exhaust line fits in a central opening of booster body 301 that extends the length of velocity booster 300), outlet openings 310 on inner surface 303 align with openings in an outer wall of an exhaust line to allow gas to enter the exhaust stream of the exhaust system. In some embodiments, velocity booster 300 is a connector for mounting inline in an exhaust system.

Leading face 304 and inlet openings 308, are outside of an exhaust line. In some embodiments, trailing face 306 is in the central opening, outside of the exhaust line, and outlet openings 310 open to openings in an outer wall of the exhaust line. In some embodiments, trailing face 306 and outlet openings are perpendicular to a longitudinal axis 307 that extends through a center of velocity booster 300. In some embodiments, trailing face 306 is inside an exhaust line.

In some embodiments, velocity booster 300 has inlet openings and exit holes around an entirety of the circumference of an exhaust line of an exhaust system, e.g., exhaust system 100 (FIG. 1). In some embodiments, velocity booster 300 has inlet openings and outlet openings spaced from each other around the exhaust line surface. In some embodiments, velocity booster 300 has outlet openings in a circular pattern around the exhaust line. In some embodiments, velocity booster 300 has outlet openings in a spiral pattern around the exhaust line, a linear pattern or another suitable pattern.

In some embodiments, inlet openings 308 have an inlet diameter 312 that is larger than an outlet diameter 314 of outlet openings 310. In some embodiments, inlet diameter 312 ranges from about 2 millimeters (mm) to about 5 mm. Trailing face 306 has a central opening diameter 316 equal to or less than the diameter of an exhaust line adjoining velocity booster 300. In some embodiments, central opening diameter 316 ranges from about 1 centimeter (cm) to about 10 cm. In some embodiments, inlet diameter 312 ranges from 10% of the diameter of an exhaust line upstream from velocity booster 300 to around 30% of the diameter of exhaust line 302. In some embodiments, outlet diameter 314 of outlet openings 310 ranges from about 50% to 20% of inlet diameter 312 of inlet openings 308. Inlet diameters 312 of inlet openings 308 that are greater than 20% of the diameter of the exhaust line tend to flood the exhaust line with gas, creating backpressure upstream from velocity booster 300 that slows exhaust removal from the exhaust source. Inlet diameters 312 that are smaller than 5% of the diameter of the exhaust line tend to draw insufficient amounts of gas into the exhaust line to impart a velocity boost to the exhaust stream and enhance transport of particles downstream from velocity booster 300. Outlet diameters 314 that are larger than about 50% of inlet diameter 312 of inlet opening 308 do not impart a velocity boost to the exhaust stream by the gas entering the exhaust stream.

A velocity of exhaust 318 entering velocity booster 300 is lower than a velocity of exhaust 320 after exiting velocity booster. Exhaust 318 entering velocity booster 300 includes gases and particulates from the exhaust source. Exhaust 320 exiting velocity booster 300 includes both gases and particulates of exhaust 318, and also gas added to exhaust 318 through the inlet and outlet openings of velocity booster 300. In some embodiments, exhaust 320 has a flow velocity that ranges from about 1 liter per minute to about 30 liters per minute.

A number of inlet openings and a number of outlet openings in velocity booster 300 is selected according to a flow velocity of exhaust 318 upstream of velocity booster 300 and to a desired flow rate of exhaust 320. In some embodiments, a number of inlet openings ranges from about 4 to about 12. When a number of inlet openings, or a diameter of inlet openings, is too large, the exhaust stream becomes flooded with gas and the particle transport capacity of the exhaust stream is reduced. When a number of inlet openings, or a diameter of inlet openings, is too small, the gas does not receive sufficient velocity boost to generate a vortex during passage through a vortex generator, such as vortex generator 110A (FIG. 1A), downstream of velocity booster 300.

Figure 3B:
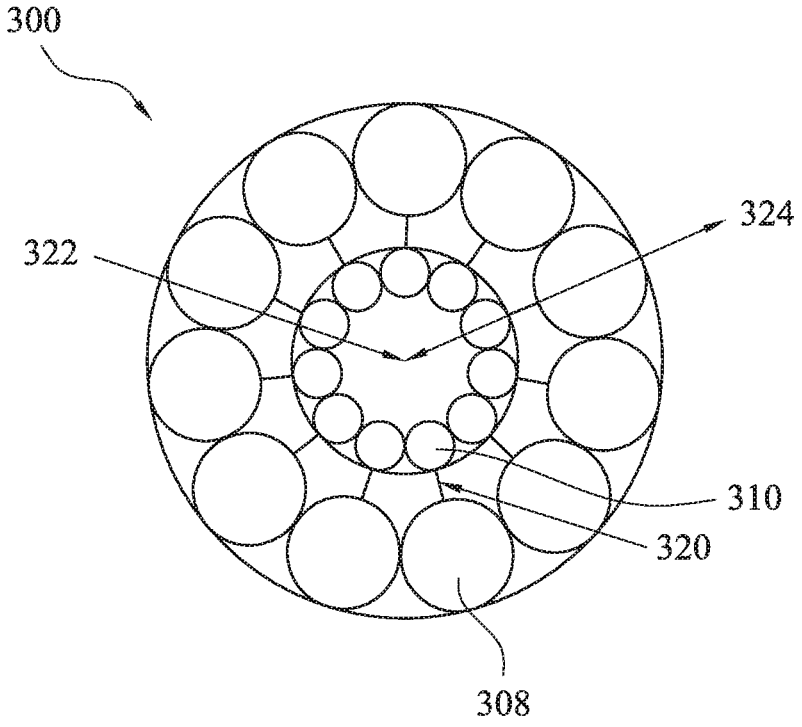
FIG. 3B is a plan view of a velocity booster, according to some embodiments.

FIG. 3B is a plan view of velocity booster 300 oriented along longitudinal axis 307, according to some embodiments. Velocity booster 300 is round. In some embodiments, the outer portion of velocity booster 300 has a rectilinear or other polygonal shape. Inlet openings 308 are aligned with corresponding outlet openings 310 along flow paths 320. Each flow path 320 aligns with an axial plane. The axial plane extends through a center 322 of velocity booster 300 and a center of the inlet opening 308 and outlet opening 310.

Figure 4A:
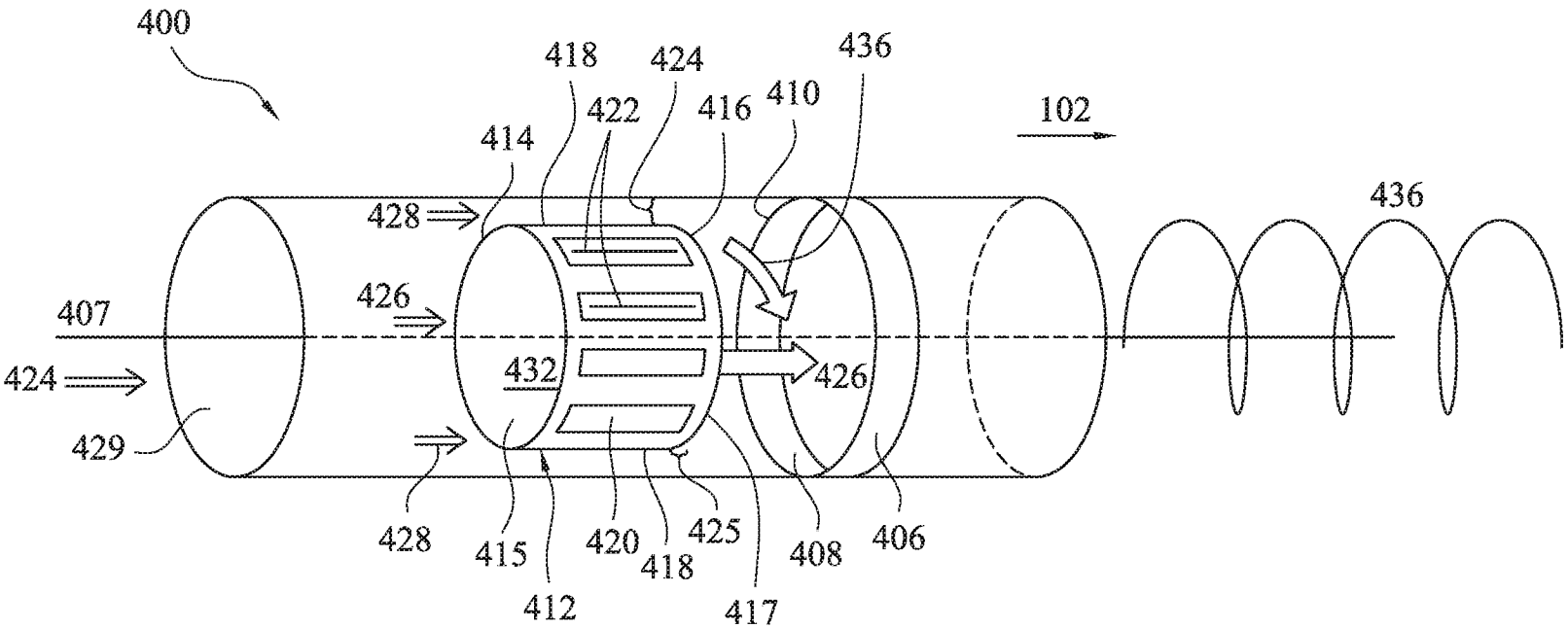
FIG. 4A is a perspective view of a vortex generator, according to some embodiments.

FIG. 4A is a perspective view of a vortex generator 400, according to some embodiments. Vortex generator 400 is usable as vortex generator 110A (FIG. 1). Vortex generator 400 is configured to fit within an interior wall of an exhaust line. Vortex generator 400 has a rotating base (annular bearing 406) that attaches to the interior wall of the exhaust line where vortex generator 400 is installed. Annular bearing 406 has an interior face 408 and a front edge 410. Annular blade assembly 412 has a leading edge 414, with leading blade assembly opening 415, at the upstream side of annular blade assembly 412. Annular blade assembly 412 also has trailing face 416, with trailing blade assembly opening 417, at the downstream side of annular blade assembly 412. Annular blade assembly 412 has openings 420 for blades (not shown). A number of blades (and blade openings) is distributed evenly and symmetrically around annular blade assembly 412 to promote smooth, even rotation of the blade assembly in the vortex generator. In some embodiments, blades are made from a same material as the body of annular blade assembly 412. In some embodiments, blades are made from a different material from that of the body of annular blade assembly 412. In some embodiments, blades are made by cutting and bending cut portions of the body of annular blade assembly 412, the blades and body of annular blade assembly being a single sheet of material. In some embodiments, openings 420 extend to front edge 410 against annular blade assembly 412. In some embodiments, openings 420 for blades 422 extend past front edge 410 of annular bearing 406 against interior wall 408. Blades of annular blade assembly 412 have a leading side (or, a leading blade face) and a trailing side (or, a trailing blade face). A leading side faces an interior wall of the exhaust line in which vortex generator 400 is mounted. A trailing side faces a center of the exhaust line where vortex generator 400 is mounted.

In some embodiments, annular blade assembly 412 is an open cylinder with leading blade assembly opening 415 and trailing blade assembly opening 417 at opposing ends of annular blade assembly 412, as described above, to allow exhaust to flow through the annular blade assembly. Side 418 is separated from the interior wall of the exhaust system by a gap 424. In some embodiments, gap 424 is a uniform gap extending from leading edge 414 to trailing face 416 and side 418 is parallel to a sidewall of the exhaust line. In some embodiments, gap 424 is a variable gap, smaller near trailing face 416 and larger near leading edge 414. In some embodiments, trailing face is connected to front edge 410 of annular bearing 406. In some embodiments, a rear portion 425 of side 418 is attached to interior wall 408 of annular bearing 406. In some embodiments, rear portion 425 is at an end of side 418 closest to trailing face 416. In some embodiments, rear portion 425 is separated from trailing face 416 on side 418.

In some embodiments, a vortex generator is a flow splitter that divides an exhaust stream into at least two portions. Vortex generator 400 divides exhaust stream 424 into two portions: a central portion 426 and a peripheral portion 428. Central portion 426 enters the interior volume 430 of annular blade assembly 412 through a front opening 432. A peripheral portion 428 of the exhaust enters interior volume 430 of vortex generator 400 by passing through gap 424 and through openings 420. Peripheral portion 428 moves over, and pushes against, blades 422 of annular blade assembly 412. Under some exhaust conditions, the motion of peripheral portion 428 over blades 422 causes annular blade assembly 412 to rotate about longitudinal axis 407 through a center of vortex generator 400. A degree of rotational motion of vortex flow 436 relates to the flow velocity of peripheral portion 428 and the pressure of the exhaust in the exhaust line. In some embodiments, blades 422 are substantially rectilinear. In some embodiments, blades are angled. In some embodiments, blades 422 extend entirely into interior volume 430. In some embodiments, blades 422 extend entirely into gap 424 between side 418 and an inner sidewall of the exhaust line. In some embodiments, blades 422 are partly extended into gap 424 and partly extended into interior volume 430. A number and a shape of blades 422 is selected according to the flow velocity of peripheral portion 428, the pressure of the exhaust in the exhaust line, and a vortex strength (related at least to the rotational speed of the vortex around longitudinal axis 434) that cleans particles out of a flow disruption site in an exhaust system. Exhaust, after passing through vortex generator 400, have a rotational component of vortex flow 436 regulated by a number and a shape of blades 422 in annular blade assembly 412.

Figure 4B:
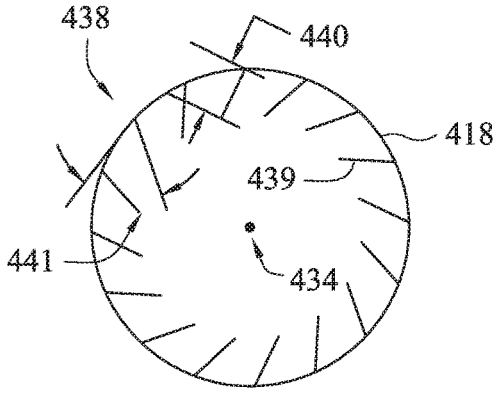
FIGS. 4B and 4C are plan views of a vortex generator, according to some embodiments.

FIG. 4B is a cross-sectional view of blade assembly 438, showing side 418 and straight blades 439. In some embodiments, straight blades 439 are used in blade assembly 412 as blades 422 (FIG. 4A). A number of blades 439 and a length 440 of blades 439 is selected according to a desired degree of mixing of peripheral portion 428 with central portion 426 in the vortex downstream of blade assembly 438. In some embodiments, straight blades 439 range from about 15% to about 40% of a distance between edge 418 and longitudinal axis 434. In some embodiments where the blade length shorter than about 15% of the distance between edge 418 and longitudinal axis 434, insufficient rotational velocity is imparted to vortex flow 436. In some embodiments where blade length is longer than 40% of the distance, the rotation of straight blades 439 through central portion 426 reduces the rotational speed of blade assembly 438 and interferes with the formation of a vortex downstream of blade assembly 438. A blade angle 441 of each straight blade 439 is selected based on gas flow characteristics of the exhaust running through the vortex generator. In some embodiments, blade angle 441 ranges from about 15-degrees to about 50-degrees. A small value of blade angle 441 is appropriate for lower exhaust flow velocity situations because low exhaust flow velocity through blade assembly 438 benefits from a more normal (i.e., closer to 90°) angle when imparting rotation on the exhaust. When blade angle 441 is too large in a lower exhaust flow velocity situation, insufficient back pressure is generated by the exhaust flow to push exhaust through annular assembly 438: gases pass through openings in annular assembly 438 and return to laminar flow downstream. A large value of blade angle 441 is appropriate for high exhaust flow velocity through blade assembly 438 to reduce back pressure and balance the induced rotation of an exhaust stream with the flow of gas through blade assembly 438. When blade angle 431 is too shallow in a high exhaust flow velocity situation, gas flow over the blades is reduced because of the back pressure induced by straight blades 439.

Figure 4C:
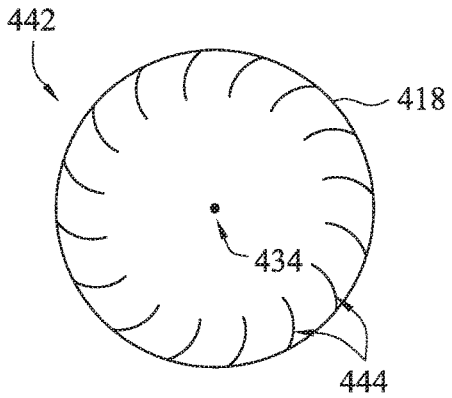

FIG. 4C is a cross-sectional view of blade assembly 442, showing side 418 and curved blades 444. In some embodiments, curved blades 444 are used in blade assembly 412 as blades 422 (FIG. 4A). A number of blades, a length of blades, and a degree of curvature of curved blades 444 is selected for blade assembly 442 according to the flow velocity of peripheral portion 428, the pressure of the exhaust in the exhaust line, and a degree of mixing of peripheral portion 428 with central portion 426 downstream of blade assembly 442. In some embodiments, an innermost edge of curved blades 444 ranges from 15% to about 40% of a distance between edge 418 and longitudinal axis 434. In embodiments where the blade length is shorter than about 15% of the distance between edge 418 and longitudinal axis 434, insufficient rotational velocity is imparted to peripheral portion. In embodiments where blade length is longer than 40% of the distance, the rotation of curved blades 444 through central portion 426 reduces the rotational speed of blade assembly 438 and interferes with the formation of a vortex downstream of blade assembly 442. The amount of curvature of curved blades 444 is determined according to the velocity of peripheral portion 428, the pressure of the exhaust in the exhaust line, and a vortex strength (related at least to the rotational speed of the vortex around longitudinal axis 434) that cleans particles out of a flow disruption site in an exhaust system. An amount of curvature of curved blades 444 is determined for blade assembly 442 by factoring the exhaust flow velocity through the exhaust system, the diameter of the exhaust line, and the number of openings/blades in blade assembly 442. Curved blades 444 are more desirable in low exhaust flow velocity systems because the curvature redirects peripheral portion 428 to a greater degree than flat blades without spinning blade assembly 442.

Figure 4D:
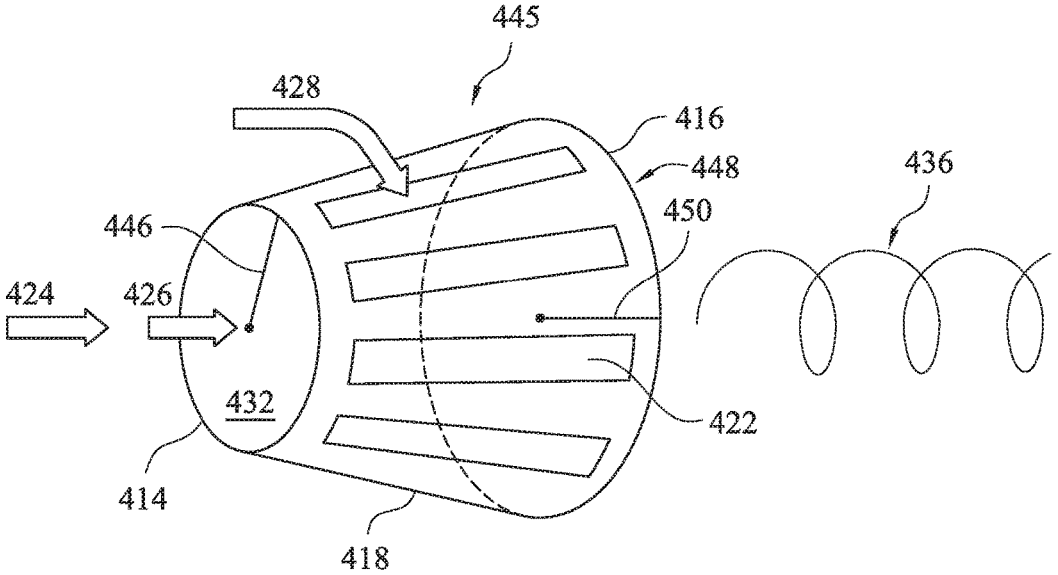
FIG. 4D is a perspective view of a vortex generator, according to some embodiments.

FIG. 4D is a schematic view of blade assembly 445, according to some embodiments. In some embodiments, blade assembly 445 is used in place of blade assembly 412 (FIG. 4A). Blade assembly 445 has leading edge 414 and trailing face 416. Leading edge 414 has an opening 432 and a first radius 446. Trailing face 416 has an opening 448 and a second radius 450. A ratio between central portion 426 and peripheral portion 428 is selected by selecting first radius 446 of blade assembly 445 to balance the division of gas between a central portion 426 of exhaust stream 424 and a peripheral portion 428 of exhaust stream 424 to generate vortex flow 436 downstream of blade assembly 445. In some embodiments, first radius 446 is a same size as second radius 450. In some embodiments, first radius 446 is smaller than second radius 450. If first radius 446 is greater than second radius 450, a flow of peripheral portion 428 is reduced and no vortex flow is formed, in some instances. According to embodiments, first radius 446 ranges between about 10% of the inner diameter of an exhaust line adjoining blade assembly 445 to about 40% of the inner diameter of the exhaust line. In some embodiments, second radius 450 ranges from about 40% of the inner diameter of the exhaust line adjoining blade assembly 445, to about 45% of the inner diameter of the exhaust line. In some embodiments, a ratio of first radius 446 to second radius 450 ranges from 1:4.5 to 4:4.5. In embodiments where first radius 446 is below about 10%, central portion 426 is too small for a vortex to perpetuate downstream motion of vortex 432. In some embodiments, where first radius 446 is larger than 45% of a radius of an exhaust line, rotational velocity is insufficient to generate a self-sustaining vortex downstream of blade assembly 445.

Figure 5:
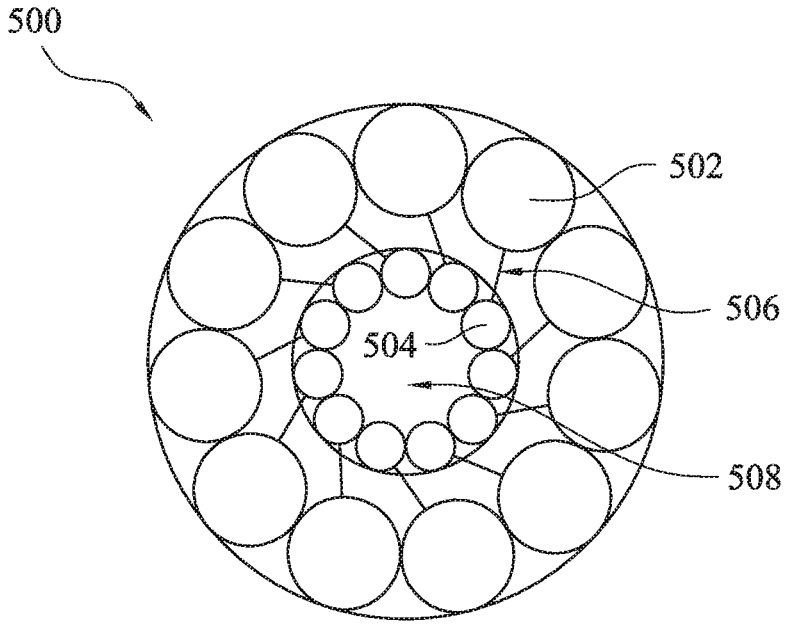
FIG. 5 is a plan view of a vortex generator, according to some embodiments.

FIG. 5 is a plan view of a stationary vortex generator 500, according to embodiments. In some embodiments, stationary vortex generator 500 is used in place of vortex generator 110*a* or 110*b* in exhaust system 100 (FIG. 1). Stationary vortex generator 500 resembles velocity booster 300. Stationary vortex generator 500 includes inlet openings 502 and outlet openings 504. Inlet openings 502 are located outside an exhaust line, while outlet openings are configured to allow gas to enter an exhaust line. In some embodiments, outlet openings 504 are positioned against an outer wall of an exhaust line and align with holes in the exhaust line. In some embodiments, stationary vortex generator 500 is positioned partly within and partly outside an exhaust line, and the exhaust stream passes through the center 508 of stationary vortex generator 500 as gas is added (through inlet openings 502 and outlet openings 504) to a region of the exhaust stream adjacent to an inner sidewall of the exhaust line.

Each inlet opening 502 is connected to a corresponding outlet opening 504 by a flow path 506. Flow path 506 is angled away from center 508 of stationary vortex generator 500. The angular offset of flow path 506 away from center 508 of stationary vortex generator adds rotational motion to an exhaust flow passing through center 508 of stationary vortex generator 500. In some embodiments, an angle of flow path 506 ranges from about 10° to about 25°. If the angle of flow path 506 is too great, then a risk of "dead" zones in the flow path increases, in some instances. If the angle of flow path 506 is too small, then a rotation of the exhaust is insufficient to create a vortex flow, in some instances.

Figure 6:
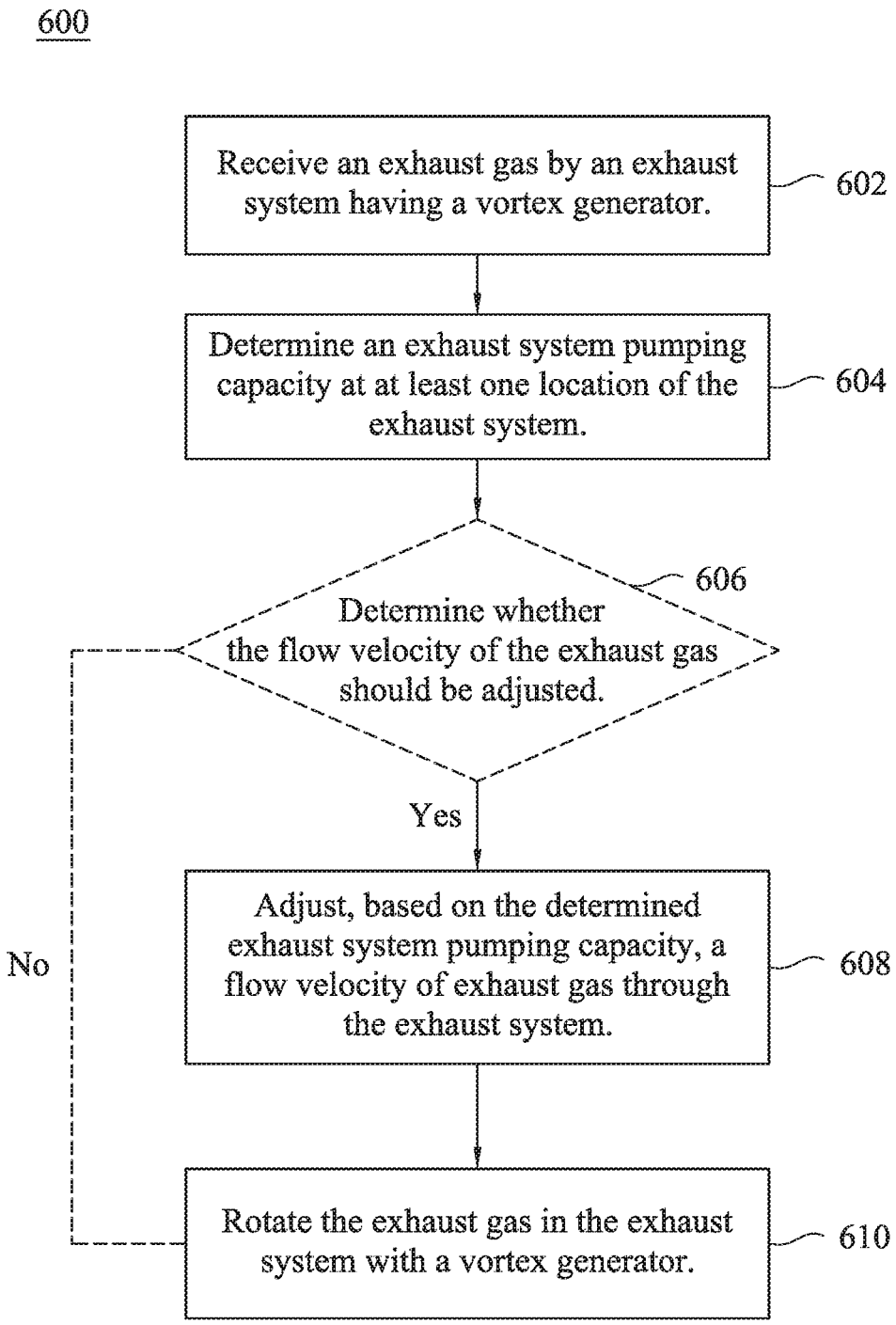
FIG. 6 is a flow diagram of a method of using a vortex generator, according to some embodiments.

FIG. 6 is a flow diagram of a method 600 of reducing particle adhesion in an exhaust system. The method 600 includes operation 602, where exhaust is received by an exhaust system comprising a vortex generator. Exhaust originates in a manufacturing tool, such as a semiconductor manufacturing tool, and contains both gaseous and particulate matter components to be exhausted from the manufacturing tool. In some embodiments, the exhaust also contains purge gas (used to maintain a positive pressure relative to external atmosphere, reducing particle intrusion into a manufacturing tool) from the manufacturing tool. In some embodiments, exhaust also includes atmospheric gases.

The method 600 further includes operation 604, wherein a pumping capacity of the exhaust system is determined. Pumping capacity relates to the ability of an exhaust system to remove gases and particulate matter from a manufacturing chamber. In some embodiments, pumping capacity is determined by measuring a pressure differential between atmosphere, outside the exhaust system, and the interior of an exhaust system. In some embodiments, a pressure differential is measured at multiple locations in an exhaust system to identify flow disruption points in the exhaust system. Flow disruption points include, according to some embodiments, connectors in the exhaust system, bends in the exhaust system piping, and locations that experience elevated particle adhesion on interior walls of the exhaust system due to corrosion, condensation, or adhesion of pre-formed particles to an interior wall of the exhaust system. In some embodiments, pumping capacity is used to determine when the maintenance on the exhaust system should be performed.

The method 600 includes operation 606, wherein, after determining an exhaust system pumping capacity, a determination is made about whether the flow velocity of the exhaust should be adjusted. In some embodiments, operation 606 is omitted from method 600. A determination of whether to adjust a flow velocity is based, in some embodiments, on a predetermined specification for exhaust flow and pumping efficiency of an exhaust system. In some embodiments, determining whether to adjust a gas flow velocity is performed periodically through a manufacturing process to maintain efficient exhaust pumping.

The method 600 includes operation 608, wherein a flow velocity of the exhaust passing through the exhaust system is adjusted according to the measured pumping capacity of the exhaust system. In some embodiments, where exhaust pumping capacity is diminished because of partial blockage of an exhaust line, a flow velocity is adjusted (typically increased) in order to boost gas velocity through the exhaust system. In some embodiments, flow velocity is increased to remove particles that partially obstruct an exhaust line. In some embodiments, operation 608 is omitted from method 600.

In some embodiments, flow velocity is adjusted by a flow regulator that restricts gas flow through the exhaust system. In some embodiments, a flow regulator includes a ball valve, a butterfly valve, or other flow regulator that is installed inline with the exhaust system. In some embodiments, flow velocity is regulated by bleeding external gas, such as atmosphere, into the exhaust system. In some embodiments, flow velocity is adjusted by regulating a pump speed.

In some embodiments, adjusting a flow velocity of exhaust through the exhaust system includes directing the exhaust through a velocity booster. A velocity booster operates according to Bernoulli's law, where gas (such as atmosphere outside an exhaust system) entering velocity booster (a Bernoulli device) through large openings, is accelerated upon exiting the velocity booster through smaller openings that direct the added gas into the exhaust system. A velocity booster boosts the speed of exhaust downstream from the velocity booster and reduces the likelihood of particle adhesion to interior sidewalls of the exhaust system by shrinking the static boundary layer adjoining the exhaust line sidewall. In some embodiments, a velocity booster is in a main exhaust line between an exhaust source and an exhaust pump. In some embodiments, a velocity booster is in a first branch of a fork of an exhaust system, in parallel with a velocity booster bypass in a second fork of the exhaust system, where either one of the velocity booster of the bypass is selected to receive the flow of exhaust. A velocity booster bypass is used in some embodiments of exhaust system to permit operation of an exhaust system during operation of maintenance of the exhaust system. In some embodiments, an exhaust flow is split between velocity booster fork and bypass fork to regulate a flow velocity of exhaust passing through the exhaust system.

The method 600 includes operation 610, wherein the exhaust in the exhaust system is rotated by being directed through a vortex generator. A vortex is a revolving volume of gas that maintains rotational movement without external influence, once generated. A vortex, when generated, is able to travel laterally a larger distance than a similar volume of air that has been forcefully moved through an orifice without generating a vortex. A vortex in an exhaust system provides a second direction of air movement (around the interior of the exhaust line, in addition to laterally through the exhaust line) to help dislodge particles from interior sidewalls of an exhaust system and to prolong high-velocity movement of the exhaust, reducing particle adhesion across the duration of the vortex in the exhaust system. A vortex generator is installed in an exhaust system upstream (closer to the exhaust source) from a flow disruption site to reduce particle adhesion and blockage of the exhaust system at the flow disruption site. A flow disruption site is a bend in an exhaust system, a connector in an exhaust system, a region where the interior surface of the exhaust system has a different surface texture, or a change in the smoothness of the interior wall of the exhaust system, or a location where the temperature of the exhaust system changes (cools, typically) and particle adhesion to the interior surface of the exhaust system changes (increases). A vortex generator upstream from a flow disruption site reduces, by means of increased exhaust velocity, the thickness of the boundary layer of the exhaust through the flow disruption site, allowing the exhaust to push more forcefully on particles that contact the interior wall of the exhaust system. Pushing more forcefully on particles enables the exhaust to overcome a sticking coefficient of particles on the exhaust wall, moving them downstream toward an exhaust pump or scrubber to remove them from the exhaust system.

Figure 7:
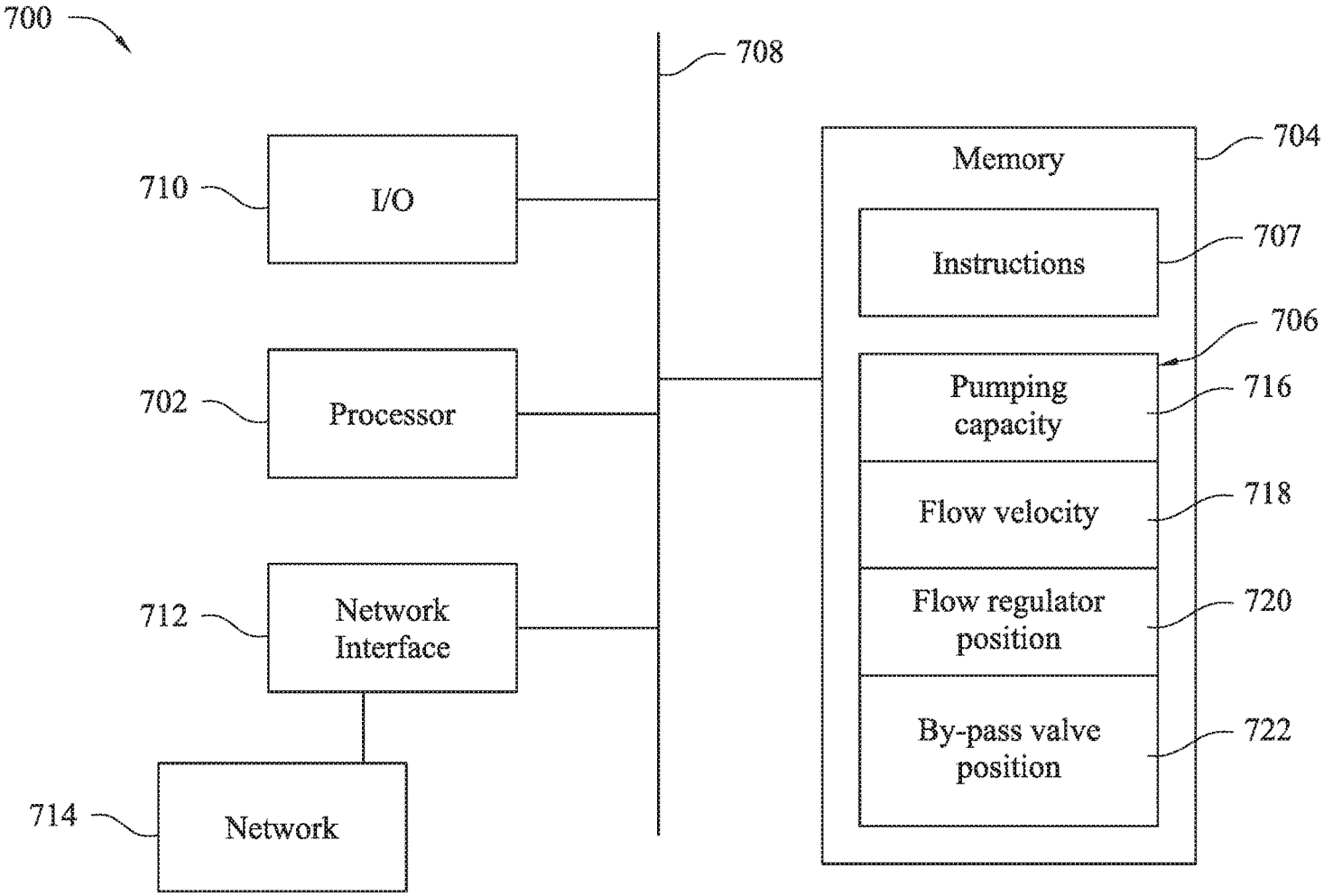
FIG. 7 is a block diagram of a controller for controlling an exhaust system in accordance with some embodiments.

FIG. 7 is a block diagram of a controller 700 for controlling an exhaust system in accordance with some embodiments. Controller 700 includes a hardware processor 702 and a non-transitory, computer readable storage medium 704 encoded with, i.e., storing, the computer program code 706, i.e., a set of executable instructions. Computer readable storage medium 704 is also encoded with instructions 707 for interfacing with machines, such as velocity boosters, vortex generators, flow regulators, by-pass valves or other suitable machines. The processor 702 is electrically coupled to the computer readable storage medium 704 via a bus 708. The processor 702 is also electrically coupled to an I/O interface 710 by bus 708. A network interface 712 is also electrically connected to the processor 702 via bus 708. Network interface 712 is connected to a network 714, so that processor 702 and computer readable storage medium 704 are capable of connecting to external elements via network 714. The processor 702 is configured to execute the computer program code 706 encoded in the computer readable storage medium 704 in order to cause system 700 to be usable for performing a portion or all of the operations as described in method 600.

In some embodiments, the processor 702 is a central processing unit (CPU), a multi-processor, a distributed processing system, an application specific integrated circuit (ASIC), and/or a suitable processing unit.

In some embodiments, the computer readable storage medium 704 is an electronic, magnetic, optical, electromagnetic, infrared, and/or a semiconductor system (or apparatus or device). For example, the computer readable storage medium 704 includes a semiconductor or solid-state memory, a magnetic tape, a removable computer diskette, a random access memory (RAM), a read-only memory (ROM), a rigid magnetic disk, and/or an optical disk. In some embodiments using optical disks, the computer readable storage medium 504 includes a compact disk-read only memory (CD-ROM), a compact disk-read/write (CD-R/W), and/or a digital video disc (DVD).

In some embodiments, the storage medium 704 stores the computer program code 706 configured to cause controller 700 to perform method 600. In some embodiments, the storage medium 704 also stores information needed for performing a method 600 as well as information generated during performing the method 600, such as a pumping capacity parameter 716, a flow velocity parameter 718, a flow regulator position parameter 720, a by-pass valve position parameter 722 and/or a set of executable instructions to perform the operation of method 600.

In some embodiments, the storage medium 704 stores instructions 707 for interfacing with machines. The instructions 707 enable processor 702 to generate instructions readable by the machines to effectively implement method 600.

Controller 700 includes I/O interface 710. I/O interface 710 is coupled to external circuitry. In some embodiments, I/O interface 710 includes a keyboard, keypad, mouse, trackball, trackpad, and/or cursor direction keys for communicating information and commands to processor 702.

Controller 700 also includes network interface 712 coupled to the processor 702. Network interface 712 allows controller 700 to communicate with network 714, to which one or more other computer systems are connected. Network interface 712 includes wireless network interfaces such as BLUETOOTH, WIFI, WIMAX, GPRS, or WCDMA; or wired network interface such as ETHERNET, USB, or IEEE-1394. In some embodiments, method 600 is implemented in two or more controllers 700, and information such as memory type, memory array layout, I/O voltage, I/O pin location and charge pump are exchanged between different controllers 700 via network 714.

Controller 700 is configured to receive information related to the exhaust through I/O interface 710 or network interface 712. The information is transferred to processor 702 via bus 708 to determine whether to actuate components of the exhaust system such as a velocity booster, a vortex generator, a flow regulator, a by-pass valve or another suitable component. The information is stored in computer readable medium 704 as pumping capacity parameter 716, flow velocity parameter 718, flow regulator position parameter 720, by-pass valve position parameter 722 or other suitable parameters.

During operation, processor 702 executes a set of instructions to determine whether to selectively activate components of the exhaust system based on the stored information. In some embodiments, processor 702 is configured to only activate or de-activate any given component. In some embodiments, processor 702 is configured to provide graduated control of at least one component. For example, in some embodiments, process 702 is configured to control an amount of gas passing through a velocity booster in order to control the flow velocity in an exhaust system.

Some aspects of the present disclosure relate to a vortex generator for an exhaust system. The vortex generator includes an annular bearing for mounting on an interior surface of an exhaust line. The vortex generator further includes an annular blade assembly mounted on the annular bearing. The annular blade assembly includes a leading face with an upstream opening. The flow splitter further includes a trailing face with a downstream opening, wherein the upstream opening and the downstream opening are centered around a longitudinal axis of the exhaust line. The flow splitter further includes a side extending from the leading face to the trailing face, wherein the side has a plurality of openings, each opening of the plurality of openings containing a blade, and wherein a trailing side of each blade faces the longitudinal axis.

Some aspects of the method relate to a method of using a vortex generator in an exhaust system. The method includes receiving exhaust by the exhaust system, wherein the exhaust contains particles and gas. The method further includes determining a pumping capacity of the exhaust system. The method further includes directing the exhaust through a vortex generator to create a vortex flow about a longitudinal axis of an exhaust line of the exhaust system.

Some aspects of the present disclosure relate to an exhaust system. The exhaust system includes an exhaust source; and an exhaust line extending from the exhaust source, the exhaust line having a first flow disruption site. The exhaust system further includes a vortex generator. The exhaust source is upstream from the flow disruption site. The vortex generator is along the exhaust line between the flow disruption site and the exhaust source.

While the disclosure has been described by way of example and in terms of the above embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation to encompass all such modifications and similar arrangements.

What is claimed is:

1. A vortex generator for an exhaust system, comprising:
- an annular bearing for mounting on an interior surface of an exhaust line; and
- an annular blade assembly mounted on the annular bearing, wherein the annular blade assembly comprises:
  - a leading face with an upstream opening,
  - a trailing face with a downstream opening, wherein the upstream opening and the downstream opening are centered around a longitudinal axis of the exhaust line, and
  - a side extending from the leading face to the trailing face, wherein the side has a plurality of openings, each opening of the plurality of openings containing a blade, wherein a trailing side of each blade faces the longitudinal axis, and each opening of the plurality of openings extends beyond the annular bearing in a direction parallel to the longitudinal axis.

2. The vortex generator of claim 1, wherein the annular bearing has a rotatable interior portion.

3. The vortex generator of claim 2, wherein the trailing face is mounted on a leading face of the rotatable interior portion.

4. The vortex generator of claim 2, wherein the side is mounted on an interior wall of the rotatable interior portion.

5. The vortex generator of claim 1, wherein each blade contained in the plurality of openings is a flat blade.

6. The vortex generator of claim 1, wherein each blade contained in the plurality of openings is a curved blade.

7. The vortex generator of claim 1, wherein a radius of the upstream opening is equal to a radius of the downstream opening.

8. The vortex generator of claim 1, wherein a radius of the upstream opening is smaller than a radius of the downstream opening.

9. The vortex generator of claim 1, wherein an entirety of the side is parallel to the longitudinal axis.

10. A method of using a vortex generator in an exhaust system, comprising:

receiving exhaust by the exhaust system, wherein the exhaust contains particles and gas;

and directing the exhaust through a vortex generator to create a vortex flow about a longitudinal axis of an exhaust line of the exhaust system, wherein directing the exhaust through the vortex generator comprises directing the exhaust through an opening in a rotatable annular body, wherein the opening extends in a longitudinal direction of the exhaust system, and the opening includes a portion upstream of an annular bearing supporting the rotatable annular body.

11. The method of claim 10, further comprising:

adjusting a flow velocity of the exhaust through the exhaust system using a velocity booster.

12. An exhaust system, comprising:

an exhaust source;

an exhaust line extending from the exhaust source, the exhaust line having a first flow disruption site;

a vortex generator, wherein the exhaust source is upstream from the flow disruption site, and the vortex generator is along the exhaust line between the flow disruption site and the exhaust source;

a second flow disruption site of the exhaust line in the downstream direction from the first flow disruption site; and a second vortex generator connected to the exhaust line between the first flow disruption site and the second flow disruption site.

13. The exhaust system of claim 12, further comprising a velocity booster connected to the exhaust line between the exhaust source and the vortex generator.

14. The exhaust system of claim 12, wherein the vortex generator comprises:

an annular bearing for mounting on an interior surface of an exhaust line; and an annular blade assembly mounted on the annular bearing, wherein the annular blade assembly comprises:

a leading face with an upstream opening, a trailing face with a downstream opening, wherein the upstream opening and the downstream opening are centered around a longitudinal axis of the exhaust line, and a side extending from the leading face to the trailing face, wherein the side has a plurality of openings, each opening of the plurality of openings containing a blade, and wherein a trailing side of each blade faces the longitudinal axis.

15. The exhaust system of claim 14, wherein a radius of the upstream opening is equal to a radius of the downstream opening.

16. The exhaust of claim 14, wherein a radius of the upstream opening is smaller than a radius of the downstream opening.

17. The exhaust system of claim 12, further comprising a flow regulator in the exhaust line between the vortex generator and the flow disruption site.

18. The exhaust system of claim 12, wherein the first flow disruption site is a bend in the exhaust line or a connector.

19. The vortex generator of claim 1, wherein each opening of the plurality of openings extends beyond an upstream side of the annular bearing.

20. The exhaust system of claim 14, wherein each opening of the plurality of openings extends beyond an upstream side of the annular bearing.

* * * * *